US007614244B2

(12) United States Patent
Venkatakrishnan et al.

(10) Patent No.: US 7,614,244 B2
(45) Date of Patent: Nov. 10, 2009

(54) ICE PRODUCING APPARATUS AND METHOD

(75) Inventors: Natarajan Venkatakrishnan, Louisville, KY (US); Matthew William Davis, Prospect, KY (US); Krzysztof Struminski, Louisville, KY (US); Wayne Lawson, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 385 days.

(21) Appl. No.: 11/614,253

(22) Filed: Dec. 21, 2006

(65) Prior Publication Data

US 2008/0148761 A1 Jun. 26, 2008

(51) Int. Cl.
*F25C 5/18* (2006.01)

(52) U.S. Cl. ..... 62/187; 62/344; 62/353

(58) Field of Classification Search ..... 62/187, 62/344, 353, 441

See application file for complete search history.

(56) References Cited

U.S. PATENT DOCUMENTS

| | | | | |
|---|---|---|---|---|
| 3,382,683 | A * | 5/1968 | Wiljanen | 62/186 |
| 3,659,429 | A * | 5/1972 | McLean | 62/157 |
| 4,688,393 | A * | 8/1987 | Linstromberg et al. | 62/187 |
| 6,945,068 | B2 | 9/2005 | Kim et al. | |
| 6,964,177 | B2 | 11/2005 | Lee et al. | |
| 7,065,975 | B1 | 6/2006 | Herndon et al. | |
| 7,076,967 | B2 | 7/2006 | Lee et al. | |
| 2005/0056043 | A1 | 3/2005 | Lee et al. | |
| 2005/0061016 | A1 | 3/2005 | Lee et al. | |
| 2005/0178145 | A1 | 8/2005 | Lee et al. | |
| 2005/0210909 | A1 | 9/2005 | Kim et al. | |
| 2005/0252232 | A1 | 11/2005 | Lee et al. | |
| 2006/0086127 | A1 | 4/2006 | Anselmino et al. | |
| 2006/0086128 | A1 | 4/2006 | Maglinger et al. | |
| 2006/0086129 | A1 | 4/2006 | Anselmino et al. | |
| 2006/0086131 | A1 | 4/2006 | Pastryk et al. | |
| 2006/0086132 | A1 | 4/2006 | Maglinger et al. | |
| 2006/0086135 | A1 | 4/2006 | Wu et al. | |
| 2006/0090496 | A1 | 5/2006 | Adamski et al. | |

* cited by examiner

*Primary Examiner*—William E Tapolcai
(74) *Attorney, Agent, or Firm*—Global Patent Operation; Douglas D. Zhang

(57) ABSTRACT

A refrigerator includes a first storage compartment defining a first interior volume. A first evaporator is disposed in a first evaporator compartment and is configured to provide cool air to the first interior volume. A second storage compartment defines a second interior volume, the second interior volume configured to be cooled by cool air received from the first interior volume. A door is positionable to permit and prohibit access to the second interior volume through a front of the second interior volume. A third interior volume is defined in an interior of the door. A second evaporator is disposed in a second evaporator compartment and is configured to provide cool air to the third interior volume. An air flow channel extends from the second evaporator compartment to the third interior volume. A fan is disposed in the third interior volume. A mold is disposed in the third interior volume and is configured to receive water and to retain the water during cooling of the water.

18 Claims, 13 Drawing Sheets

ICE PRODUCING APPARATUS AND METHOD

BACKGROUND OF THE INVENTION

The described technology relates to an ice producing apparatus, such as for a bottom freezer refrigerator that includes a freezer compartment disposed below a fresh food compartment, and a corresponding method.

A known bottom freezer refrigerator includes a freezer storage compartment (freezer compartment) disposed below a fresh food storage compartment (fresh food compartment). In the known bottom freezer refrigerator, a temperature of an interior volume of the freezer compartment is generally maintained at or below a standard freezing point temperature of water (e.g., at or below 0 degrees Celsius), while a temperature of an interior volume of the fresh food compartment is generally maintained above the standard freezing point temperature of water (e.g., above 0 degrees Celsius). Specifically, the known bottom freezer refrigerator includes a cooling system with an evaporator that is disposed in an evaporator housing in the freezer compartment. The cooling system operates in a conventional manner, such that the evaporator cools the air in a volume adjacent the evaporator by absorption of energy from the air. This cold air flows from the volume adjacent the evaporator to the interior volume of the freezer compartment to cool the interior volume of the freezer compartment. Cool air from the volume adjacent the evaporator also flows to the interior volume of the fresh food compartment, to similarly cool the interior volume of the fresh food compartment. The air flows back from the interior volume of the fresh food compartment by being ducted back to the volume adjacent the known evaporator. The cycle repeats as described above.

Convenience necessitates that when a bottom freezer refrigerator includes an ice maker, the ice maker delivers ice through an opening in a door of the fresh food compartment, rather than an opening in a door of the freezer compartment. However, the cool air in the fresh food compartment is generally not cold enough to freeze water to produce and maintain the ice.

In the known bottom freezer refrigerator, the cold air is pumped from the evaporator in the freezer to the ice maker in the fresh food compartment. Such an arrangement suffers from certain disadvantages. For example, the ice is generally produced at a relatively slow rate, due to limitations of a volume and/or a temperature of the cold air pumped to the ice maker to freeze the water. This is because the same evaporator that cools the air that cools the freezer compartment and the fresh food compartment also cools the air that freezes the water to produce the ice. As a result, when the ice is produced, less cooling capacity is available to cool the freezer and fresh food compartments.

BRIEF DESCRIPTION OF EMBODIMENTS OF THE INVENTION

As described herein, embodiments of the invention overcome one or more of the above or other disadvantages known in the art.

In an embodiment, a refrigerator includes a first storage compartment defining a first interior volume. A first evaporator is disposed in a first evaporator compartment and is configured to provide cool air to the first interior volume. A second storage compartment defines a second interior volume, the second interior volume configured to be cooled by cool air received from the first interior volume. A door is positionable to permit and prohibit access to the second interior volume through a front of the second interior volume. A third interior volume is defined in an interior of the door. A second evaporator is disposed in a second evaporator compartment and is configured to provide cool air to the third interior volume. An air flow channel extends from the second evaporator compartment to the third interior volume. A fan is disposed in the third interior volume. A mold is disposed in the third interior volume and is configured to receive water and to retain the water during cooling of the water.

In another embodiment, an ice producing apparatus for a refrigerator includes a door configured to permit and prohibit access to a storage compartment interior volume of a storage compartment of a refrigerator. A door interior volume is defined in an interior of the door. A fan is disposed in the door interior volume. A mold is disposed in the door interior volume and is configured to receive water and to retain the water during freezing of the water into ice. A receptacle is disposed in the door interior volume and is configured to receive and store the ice produced in the mold.

In another embodiment, a method of forming ice in a refrigerator includes cooling a first storage compartment to a first temperature, cooling a second storage compartment to a second temperature, and cooling an interior volume defined in a door that permits and impedes access to the second storage compartment, to a third temperature. A fan disposed in the interior volume is operated to circulate cool air through the interior volume. Water is cooled to form ice in the door interior volume.

BRIEF DESCRIPTION OF THE DRAWINGS

The following figures illustrate examples of embodiments of the invention. The figures are described in detail below.

DETAILED DESCRIPTION OF EMBODIMENTS OF THE INVENTION

Figure 1:
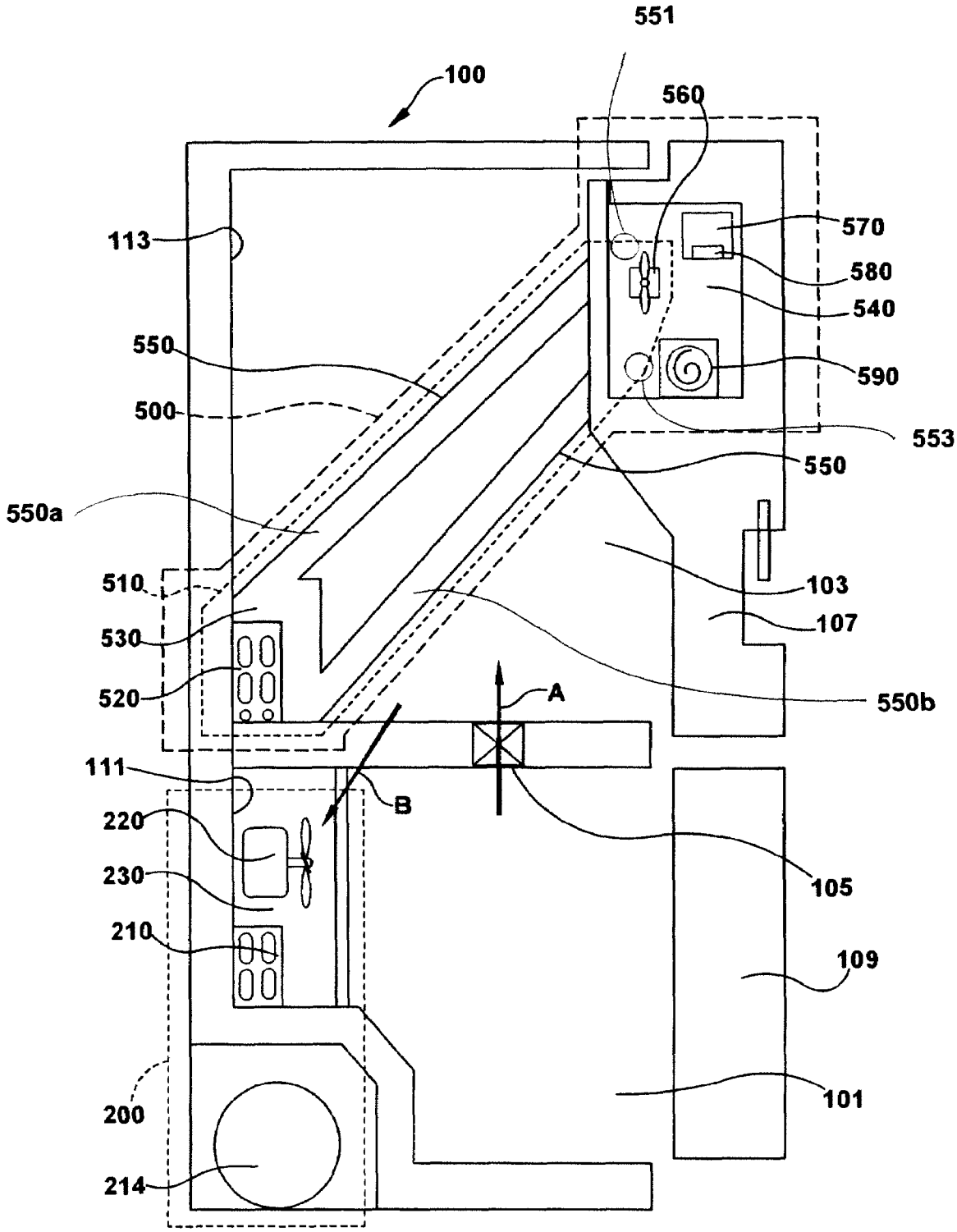
FIG. 1 is a partial cross section side view of a bottom freezer refrigerator including an ice producing apparatus, in accordance with embodiments of the present invention.

Embodiments of the invention are described below, with reference to the figures, in which like reference numbers indicate the same or similar components. In the drawings, FIG. 1 is a partial cross section side view of a bottom freezer refrigerator including an ice producing apparatus, while FIG. 2 is a front isometric view of the bottom freezer refrigerator of FIG. 1, and FIG. 3 is a front isometric view of the bottom freezer refrigerator of FIG. 1, with one door open of a top fresh food storage compartment.

Figure 2:
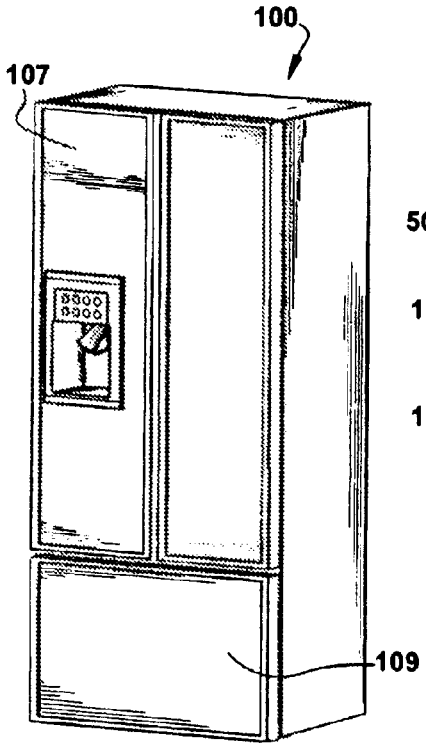
FIG. 2 is a front isometric view of the bottom freezer refrigerator of FIG. 1.
Figure 3:
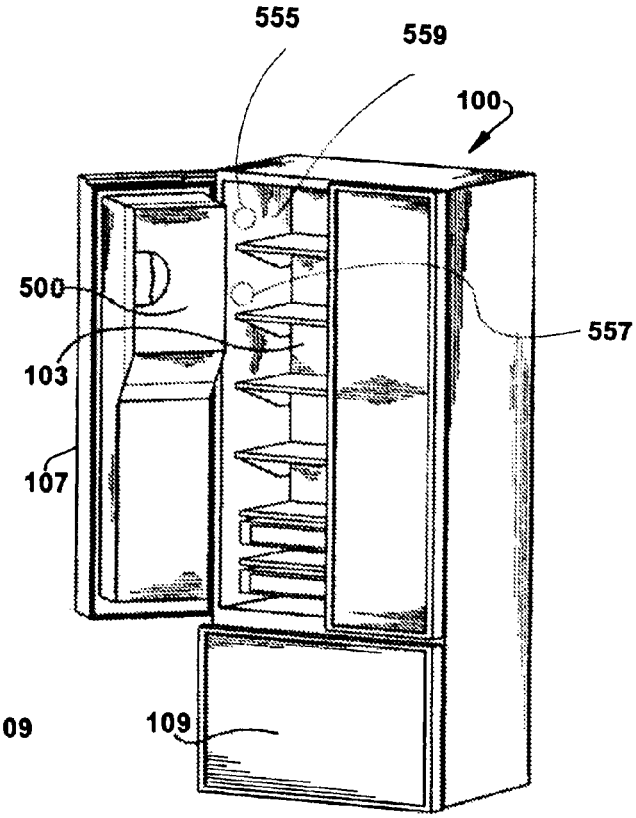
FIG. 3 is a front isometric view of the bottom freezer refrigerator of FIG. 1, with one door open of a top fresh food storage compartment.

As shown in FIGS. 1-3, a bottom freezer refrigerator assembly 100 (refrigerator 100) includes a bottom freezer storage compartment 101 (freezer compartment 101) that is disposed below a top fresh food storage compartment 103 (fresh food compartment 103), a cooling system 200 configured to directly cool the freezer compartment 101 and to indirectly cool the fresh food compartment 103, and to cool an ice producing apparatus 500. These components of the refrigerator 100 are discussed below.

The following explanation of the manner in which the cooling system 200 is employed to cool the freezer and fresh food compartment 101 and 103 is understood to be exemplary, as the refrigerator 100 that includes the ice producing apparatus 500 can be used in conjunction with various systems that directly cool and/or indirectly cool the freezer compartment 101 and/or the fresh food compartment 103.

"Directly cooling" and variations thereof are to be understood to include cooling an interior volume of a particular compartment by flowing cool air from a cooling system to the interior volume of the particular compartment without flowing the cool air through an interior volume of another intervening compartment, while "indirectly cooling" and variations thereof are to be understood to include cooling the interior volume of the particular compartment by flowing the cool air from the cooling system through the interior volume of the another intervening compartment before flowing the cool air to the interior volume of the particular compartment. "Cold", "cool" and "warm" and variations thereof are to be understood to be relative to one another, and "cool" and variations thereof are further to be understood to include a decrease in temperature.

Figure 7:
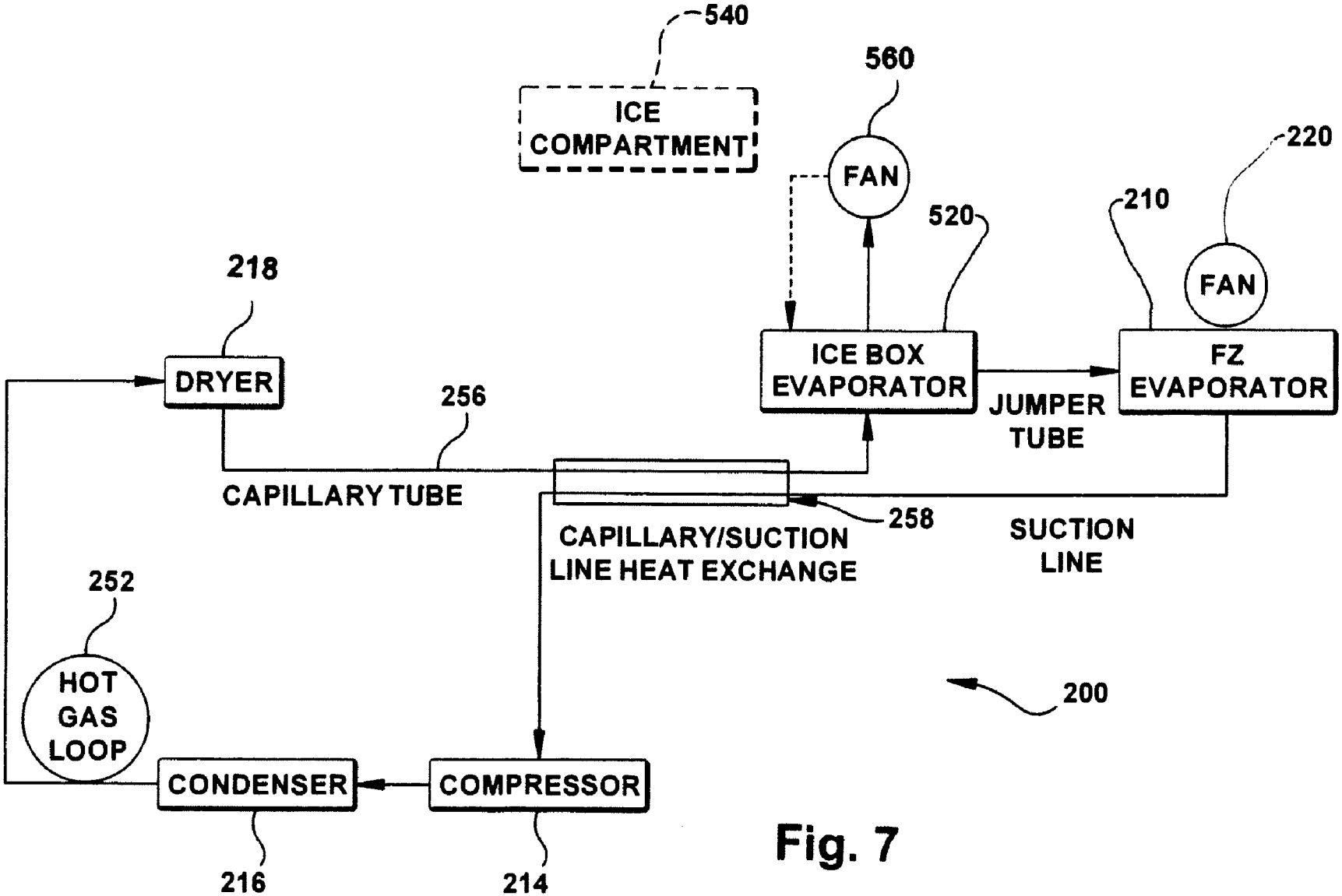
FIG. 7 is a schematic view of an exemplary cooling system for the bottom freezer refrigerator.

In general, the cooling system 200 includes a compressor 214 and a condenser 216, as well as an evaporator 210 and a fan 220 (see FIGS. 1 and 7). The cooling system 200 operates in a conventional manner, such that air in a volume adjacent the evaporator 210 is cooled by absorption of energy from the air. The evaporator 210, the volume adjacent the evaporator 210, and the fan 220 are disposed in an interior volume of an evaporator compartment 230. The evaporator compartment 230, the evaporator 210 and the fan 220 are disposed adjacent a back wall 111 of the freezer compartment 101 which is opposite a front opening of the freezer compartment 101 through which an interior volume of the freezer compartment 101 is accessible.

The cold air cooled by the evaporator 210 flows or circulates, aided by operation of the fan 220, from the volume adjacent the evaporator 210 and from the interior volume of the evaporator compartment 230 to the interior volume of the freezer compartment 101, cooling the interior volume of the freezer compartment 101 by absorbing energy and increasing in temperature. This cool air flows, such as through a damper 105, in the direction of arrow "A", from the interior volume of the freezer compartment 101 to an interior volume of the fresh food compartment 103. Thus, the interior volume of the fresh food compartment 103 is cooled when the air absorbs additional energy and further increases in temperature. The damper 105 is selectively operable to permit and to impede or prohibit air flow from the freezer compartment 101 to the fresh food compartment 103. The damper 105 is further a one-way damper, configured to impede or prohibit air from flowing hack from the fresh food compartment 103 to the freezer compartment 101. Rather, the air flows from the interior volume of the fresh food compartment 103 to the interior volume of the evaporator compartment 230 and the volume adjacent the evaporator 210, through one or more, and in certain embodiments at least two, dampers (not shown), in the direction of arrow "B." By this arrangement, the warm air flows back to the interior volume of the evaporator compartment 230 without flowing through the freezer compartment 101. The cycle repeats as described above.

It is contemplated that, in general, the freezer compartment 101 is maintained at a temperature sufficiently low for storing frozen food, which is at least at or below a standard freezing point temperature of water (e.g., at or below 0 degrees Celsius), and more typically on the order of about −18 degrees Celsius, the freezer compartment 101 being configured to store or have disposed in the interior volume frozen foods and liquids. It is also contemplated that, in general, the fresh food compartment 103 is maintained at a temperature above the standard freezing point temperature of water (e.g., above 0 degrees Celsius), typically on the order of about 3 degrees Celsius, the fresh food compartment 103 being configured to store or have disposed in the interior volume fresh (e.g., non-frozen) foods and liquids.

The ice producing apparatus 500 can be configured to produce ice, and inasmuch as the refrigerator 100 is a bottom freezer refrigerator to deliver the ice through an opening in a door 107 of the fresh food compartment 103. It is to be understood, however, that the ice producing apparatus 500 is not limited to use in the bottom freezer refrigerator. For example, the ice producing apparatus 500 can be configured to produce the ice and to provide the ice through the opening in the door of the fresh food compartment of the refrigerator in which the freezer compartment is disposed to a side of the fresh food compartment. It is contemplated that in embodiments of the invention, the door 109 is operatively similar to the door 107. Alternately, a drawer can be used in lieu of the door 109, permitting, impeding and/or preventing access to the interior volume of the freezer compartment 101 in a manner known to those or ordinary skill in the art.

The door 107 is configured to permit, impede and/or prohibit access to the interior volume of the fresh food compartment 103, depending on a position of the door 107. The door 107 is configured to permit access through a front opening of the interior volume of the fresh food compartment 103, the front opening opposite a back wall 113 of the interior volume of the fresh food compartment 103.

Operation of the cooling system 200 and the ice producing apparatus 500 are discussed in further detail below.

As shown in the figures, the ice producing apparatus 500 includes an ice compartment cooling system 510 with an evaporator 520. The evaporator 520 operates in a manner similar to the evaporator 210. Specifically, air in a volume adjacent the evaporator 520 is cooled by absorption of energy from the air, the evaporator 520 and the volume adjacent the evaporator 520 being disposed in an interior volume of an evaporator compartment 530. In the embodiment of FIG. 1, the evaporator compartment 530 and the evaporator 520 are disposed adjacent the back wall 113 of the fresh food compartment 103.

Generally, the evaporator compartment 530 is insulated to substantially thermally isolate the interior of the evaporator compartment 530 from the fresh food compartment 103, to prevent an undesired decrease in the temperature in the fresh food compartment 103.

The cold air flows from the evaporator compartment 530 to an interior volume of an ice compartment 540, cooling the interior volume of the ice compartment 540. In embodiments of the invention, the ice compartment 540 is disposed in the door 107 of the fresh food compartment 103. It is contemplated that the ice compartment 540 is insulated, such that the interior of the ice compartment 540 remains at or below the standard freezing point temperature of water for an extended period of time after cessation of the flow of the cold air thereinto.

The cold air flows from the evaporator compartment 530 to the interior volume of the ice compartment 540, through a cold air flow channel 550 that includes supply and return ducts 550*a* and 550*b*. It is contemplated that the cold air flow channel 550 is disposed within or on a side wall of the interior volume of the fresh food compartment 103. The side wall is disposed between a top wall and a bottom wall of the interior of the fresh food compartment 103, and between the front opening and the back wall of the fresh food compartment 103. One advantage of this arrangement over the known bottom freezer refrigerator in which the cool air flows to the ice maker through a mullion separating the freezer and fresh food compartments, at a bottom of the fresh food compartment, is that in the refrigerator 100 with the cold air flow channel 550 disposed within or on the side wall of the interior volume of the fresh food compartment 103, a length of the channel 550 is minimized. As a result, the cold air is moved quickly and efficiently, with minimum temperature increase, from the evaporator compartment 530 to the ice compartment 540.

Generally, the cold air flow channel 550 is insulated to substantially thermally isolate the cold air flow channel 550 from the fresh food compartment 103, to prevent an undesired decrease in the temperature in the fresh food compartment 103.

The cold air flow channel 550 is configured to permit air flow to the ice compartment 540 through an opening or inlet (described in further detail below with respect to FIGS. 4-6) in a side wall of the door 107 of the fresh food compartment 103. The side wall of the door 107 is disposed between a front wall of the door 107 and a back wall of the door 107 opposite the front wall, as well as between a top wall of the door 107 and a bottom wall of the door 107 opposite the top wall. It is contemplated that in embodiments of the invention, the opening is on the side wall that is adjacent a hinge on which the door 107 rotates. One advantage of this arrangement as compared to the known bottom freezer refrigerator in which the cold air flows to the ice maker through an opening approximate the bottom of the door of the fresh food compartment is that because the cold air flows to the top of the interior volume of the ice compartment 540, the interior volume of the ice compartment 540 is more evenly, quickly and efficiently cooled.

After the cold air cools the interior volume of the ice compartment 540 by absorbing energy and increasing in temperature, this now relatively warm air flows back through another opening or outlet (also further described with respect to FIGS. 4-6) in the side wall of the door 107 of the fresh food compartment 103, from the interior volume of the ice compartment 540 to the interior volume of the evaporator compartment 530 and to the volume adjacent the evaporator 520. This flow back to the interior volume of the evaporator compartment 530 can be accomplished through a flow path in the cold air flow channel 550 that is separate from a flow path in which the cold air flows to the interior volume of the ice compartment 540. Thus, by this arrangement, the flow channel 550 can include two separate flow paths. The cycle repeats as described above.

The ice compartment cooling system 510 further includes a fan 560 disposed within the interior volume of the ice compartment 540. Operation of the fan 560 results in the above described air flow into and out of the ice compartment 540, as the fan pulls the cold air from the evaporator 520 into the ice compartment 540, and pushes the cold air through the ice compartment 540 and back toward the evaporator 520. Operation of the fan 560 also results in the cooling of the interior volume of the ice compartment 540, as the fan 560 distributes the cold air throughout the interior volume of the ice compartment 540. Temperature gradients may form in the ice compartment 540, particularly when the ice is stored in the ice compartment 540. By disposing the fan 560 in the ice compartment 540 rather than in the evaporator compartment 530, operation of the fan 560 can provide quick and efficient equalization of the temperature in the ice compartment 540 by increasing the air flow therein, without necessarily requiring operation of the compressor 214 and the evaporator 520. Thus, operation of the compressor 214 and the evaporator 520 can be less frequent, decreasing operating costs for the ice producing apparatus 500. Alternately, operation of the fan 560 can be restricted to a same time period as the cooling of the air with the ice compartment cooling system 510, thereby decreasing a run time of the fan 560.

An ice forming device 570 is disposed in the interior volume of the ice compartment 540. The ice forming device 570 includes an ice mold 580, having at least one cavity that receives, in a known manner, water that is to be frozen into the ice. By this arrangement, the cold air flowing from the interior volume of the evaporator compartment 530 into the interior volume of the ice compartment 540 absorbs heat from a volume adjacent the ice mold 580, decreasing a temperature of the water in the ice mold 580 to a temperature at or below the standard freezing point temperature of water (e.g., at or below 0 degrees Celsius). The fan 560 is operative to cause the flow of air from evaporator compartment 530 into the ice compartment 540 and to the ice mold 580. As a result, the water in the ice mold 580 freezes to produce the ice.

An ice receptacle 590 is disposed in the interior volume of the ice compartment 540. The ice receptacle 590 is configured to receive the ice from the ice forming device 570, to store or retain the ice therein, and to deliver the ice through the door 107. Details of the ice receptacle 590 are known to those of ordinary skill in the art, and therefore further explanation is not required to provide a complete written description of embodiments of the invention or to enable those of ordinary skill in the art to produce and use embodiments of the invention, and is not provided. Similarly, details of an ice delivery system configured to deliver the ice from the ice forming device 570 to the ice receptacle 590, whether separate from or a component of the ice forming device 570 and/or the ice receptacle 590, are also known, and are therefore neither required nor provided. Still further, details of an ice delivery system configured to deliver ice from the ice receptacle 590 through the opening in the door 107 of the fresh food compartment 103 are known.

In the refrigerator 100, the evaporator 520 is used to cool the air that forms the ice, while the evaporator 210 is used to cool the freezer compartment 101 and the fresh food compartment 103, as discussed above. One advantage over the known bottom freezer refrigerator in which the evaporator that provides the cold air to the ice maker also provides the cool air to the fresh food compartment, is that because the same evaporator that cools the freezer compartment and the fresh food compartment does not cool the air that freezes the water to produce the ice, there is no decrease in the amount of cooling capacity available to cool the fresh food and freezer compartments during ice formation. This independent air flow (e.g., the flowing of air cooled by the evaporator 210 being separate from the flowing of air cooled by the evaporator 520) results in increased ice production.

Because of the above-discussed arrangement of components therewithin, in the refrigerator 100 the cold air provided by the evaporator 210 flows to the interior volume of the freezer compartment 101. Within the freezer compartment 101, while absorbing energy and increasing in temperature, the cool air also absorbs moisture, before flowing to the fresh food compartment 103. Thus, the refrigerator 100 provides relatively moist air to the interior volume of the fresh food compartment 103 resulting in less dehydration of the items stored therein.

Figure 4:
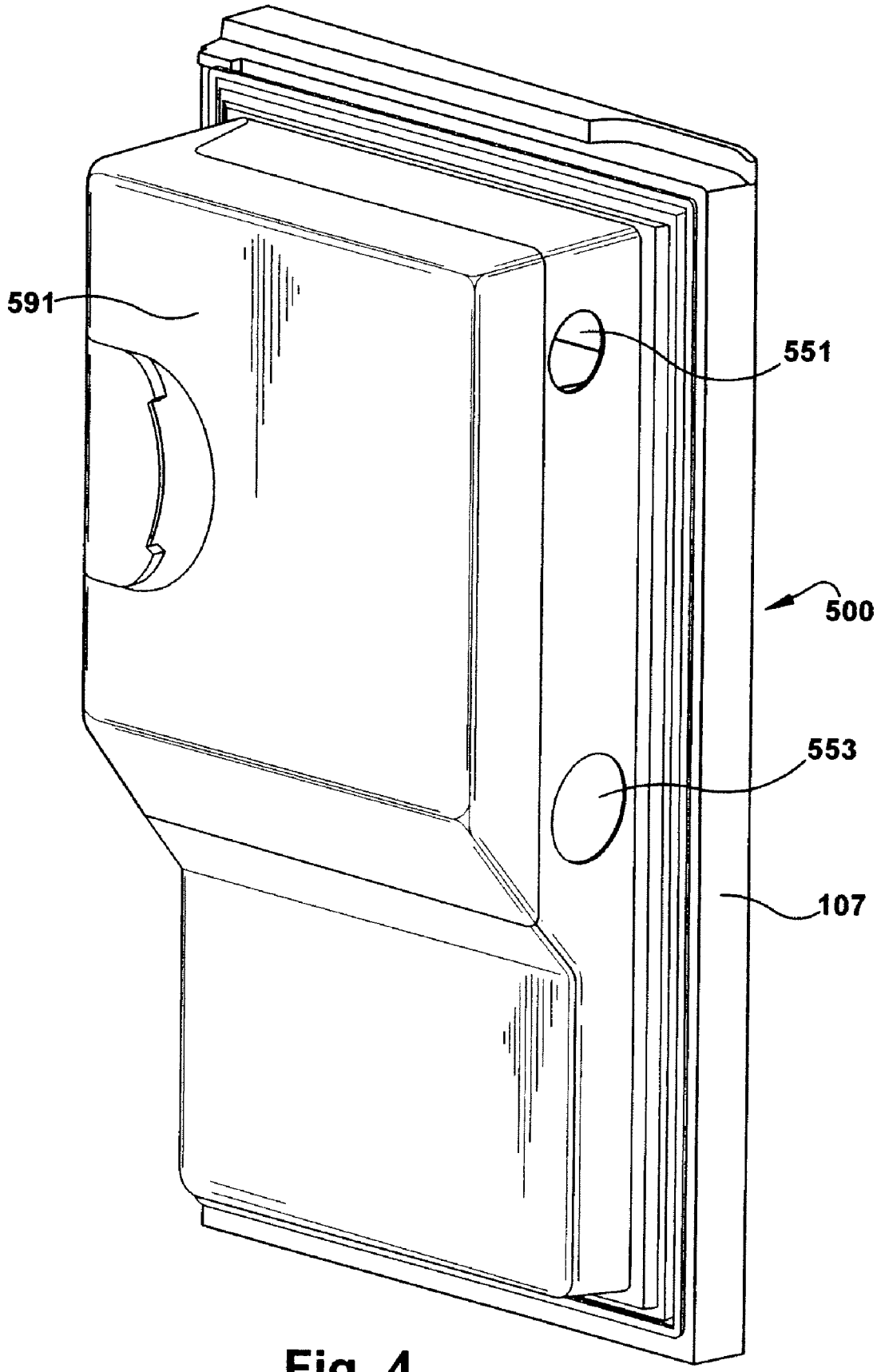
FIG. 4 is a detail view of an interior side of the door of the top fresh food storage compartment, taken from FIG. 3.
Figure 5:
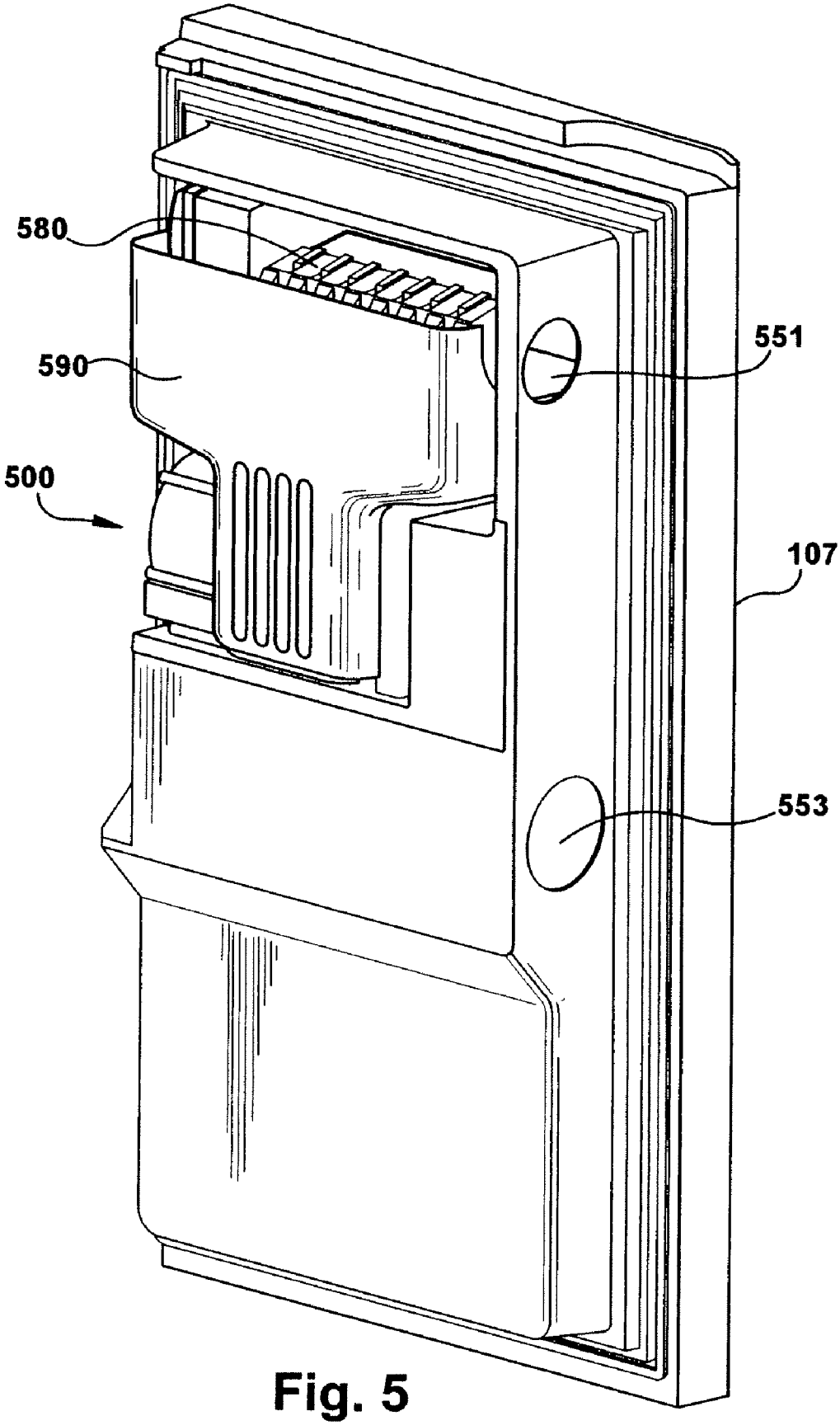
FIG. 5 is a detail view of an ice compartment of the door of FIG. 4, with a cover removed.
Figure 6:
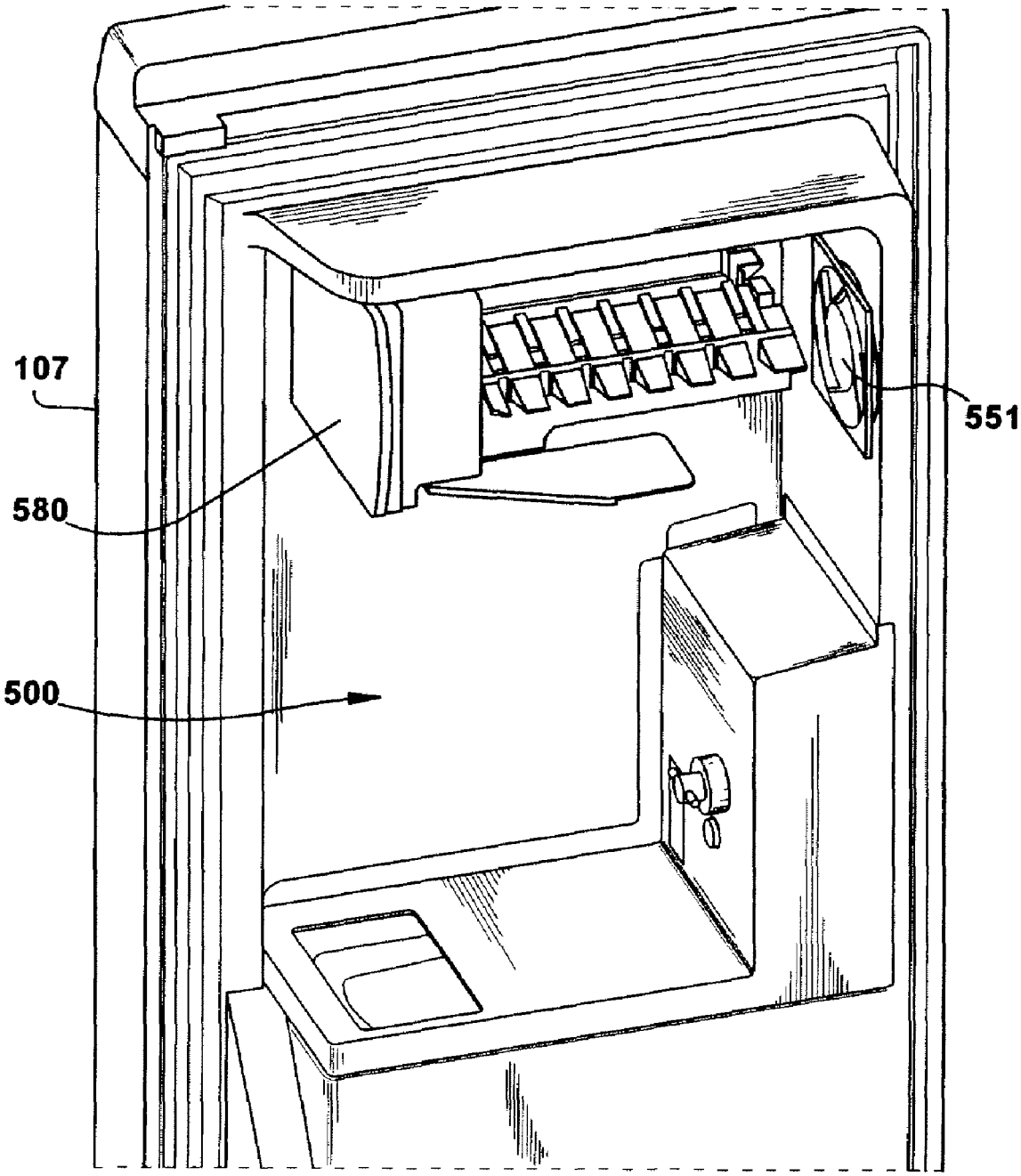
FIG. 6 is a detail view of the ice compartment of the door of FIG. 4, with an ice receptacle removed.

FIGS. 4-6 show examples of components of the ice producing apparatus 500. Specifically, FIG. 4 is a detail view of an interior side of the door 107 of the top fresh food compartment 103, while FIG. 5 is a detail view of the ice compartment 540 of the door 107, with a cover removed. FIG. 6 is a detail view of the ice compartment 540 of the door 107, with the ice receptacle 590 removed.

As discussed above, the cold air flows to the ice compartment 540 through the opening or inlet 551 in the side wall of the door 107 of the fresh food compartment 103, and the warm air flows back from the ice compartment 540 through the opening or outlet 553. The inlet and outlet 551 and 553 are arranged to align with inlet and outlet openings 555 and 557 respectively, formed in a side wall 559 of the fresh food compartment 103 (see FIG. 3) when the door 107 is closed, all these openings being located, sized and shaped to achieve the desired characteristics of the air flow to and from the ice compartment 540 and/or the ice receptacle 590.

As shown in the drawings, the ice receptacle 590 can include one or more cut-outs, holes, slots, voids, or other openings in a back surface thereof (e.g., a surface of the ice receptacle 590 adjacent a removable cover 591). The openings facilitate the flow of the cold air through the ice compartment 540 and/or through the ice receptacle 590, such that the ice disposed therein is maintained at or below the standard freezing point temperature of water.

FIG. 7 is a schematic view of an exemplary embodiment of the cooling system 200. As illustrated in the figure, the embodiment of the cooling system 200 includes a compressor 214, a condenser 216, a dryer 218 and a hot gas loop 252 linking the condenser 216 to the dryer 218. The cooling system 200 also includes the evaporator 220 and the evaporator 520. The various components are coupled to one another in a conventional manner. A capillary tube 256 couples the dryer 218 and the evaporator 520. A jumper tube couples the evaporator 520 and the evaporator 210. A suction line links the evaporator 210 to the compressor 214. In the exemplary embodiment, a heat exchanger 258 is coupled between the suction line connecting the evaporator 210 to the compressor 214 and a portion of the capillary tube 256 connecting the dryer 218 to the evaporator 520.

Figure 8:
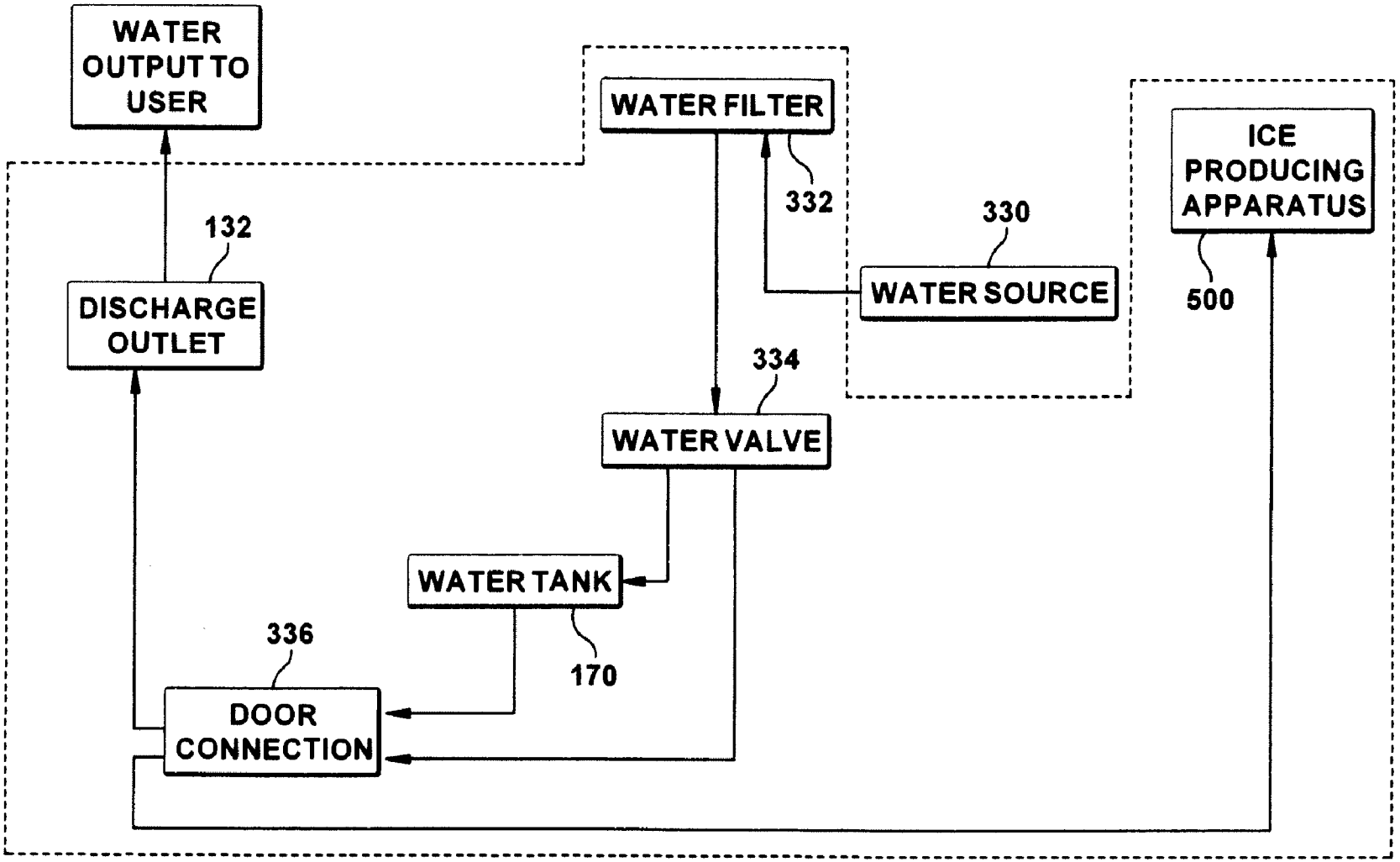
FIG. 8 is a schematic view of an exemplary water line configuration for the bottom freezer refrigerator.

FIG. 8 is a schematic view of an exemplary water line configuration of the bottom freezer refrigerator 100. As illustrated in the figure, water from a water source 330 flows through a filter 332 to be purified. A water valve 334, which is responsive to a controller 322 (See FIG. 9), controls the flow of water from the filter 332 to the ice producing apparatus 500 and to a discharge outlet 132 via a water tank 170. On demand for water to fill the ice mold 580, water is dispensed by the water valve 334 through a door connection 336 to the ice producing apparatus 500. Upon demand by the user the water is dispensed by the water valve 334 to the water tank 170 through the door connection 336 and then to the discharge outlet 132.

Figure 9:
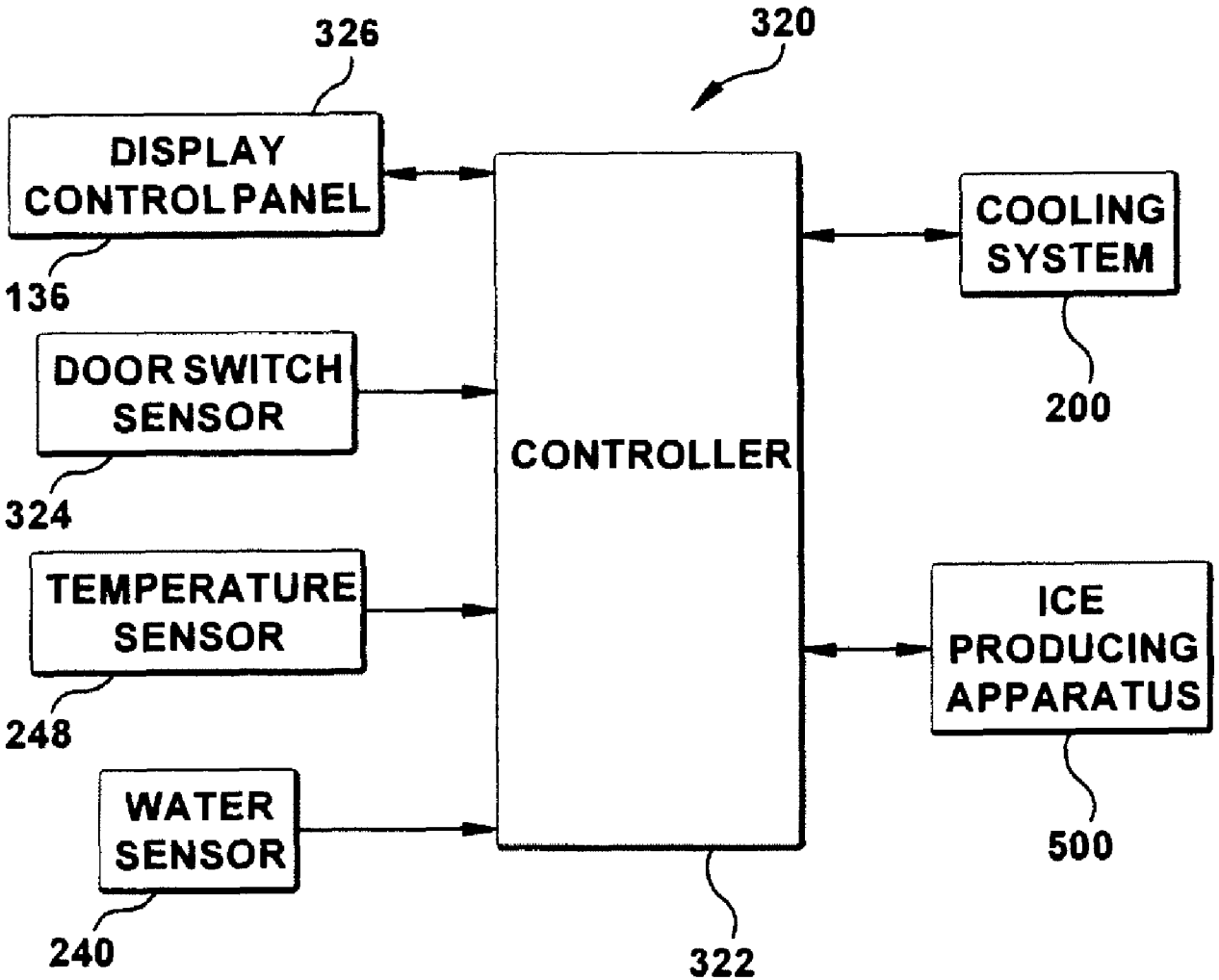
FIG. 9 is a schematic view of an exemplary control system applicable to the bottom freezer refrigerator.

FIG. 9 is a schematic view of an exemplary control system applicable to the bottom freezer refrigerator 100. As shown in the figure, a control system 320 includes the controller 322, comprising one or more microprocessors, for controlling the operation of the refrigerator 100. The controller 322 receives input signals from a control panel 136, a water sensor 240, a door switch sensor 324 for determining when at least one door 107 or 109 is open, and a temperature sensor 248 for determining a temperature of the freezer compartment 101, the fresh food compartment 103 and/or the ice compartment 540. The controller 322 can also receives signals from other inputs associated with the refrigerator 100. The controller 322 is operatively coupled to the cooling system 200 and to the ice producing apparatus 500 to control the operation of the refrigerator 100 in response to these input signals.

In an exemplary embodiment, the controller 322 operates the cooling system 200 based on inputs from the control panel 136. Specifically, the control panel 136 can include a user operable interface and a display 326 for receiving inputs from and displaying data to a user. For example, a user selects an operating temperature or related setting for the freezer compartment 101 and/or the fresh food compartment 103. Such setting is displayed on the control panel 136. Additionally, such input is transmitted to the controller 322, and the controller 322 operates the cooling system 200 to achieve the selected temperature within the various compartments 101 and 103.

In the exemplary embodiment, the controller 322 operates the cooling system 200 and the ice producing apparatus 500 based on inputs from the water sensor 240 that is arranged to sense each water fill to the ice mold 580. Upon detection of the water fill, the controller 322 operates the evaporator 520 and the fan 560 to cool the ice compartment 540 and initiates the ice making operating state for the refrigerator 100. The controller 322 also counts the water fills and initiates a defrost cycle for the ice compartment 540 in response to the occurrence of a predetermined number of such water fills.

In the exemplary embodiment, the controller 322 operates the cooling system 200 and/or the ice producing apparatus 500 as a function of the open or closed state of the doors 107 and/or 109, based on inputs from the door switch sensor 324. Specifically, when the door switch sensor 324 determines that the door 107 or 109 is in the open position, the controller 322 changes the mode of operation of the cooling system 200. For example, the cooling system 200 may interrupt or suspend normal operation of the cooling system 200 when the door is open, or alternatively, operate the cooling system 200 in another form of a power save mode when the door is open. In the exemplary embodiment, the controller 322 also changes the mode of operation of the ice producing apparatus 500 when the door switch sensor 324 determines that the door is open. Specifically, the controller 322 interrupts the ice making and/or ice dispensing operation when the door is open. Additional details of the ice making and dispensing are discussed in detail below.

In the exemplary embodiment, the controller 322 operates the cooling system 200 and/or the ice producing apparatus 500 based on inputs from the temperature sensor 248. The temperature sensor 248 can be one or more sensors located in one or more of the freezer compartment 101, the fresh food compartment 103 and the ice compartment 540. When the temperature sensor 248 determines that a temperature in the fresh food compartment 103 is below a selected temperature, such as, for example, the standard freezing point temperature of water, the cooling system 200 restricts air flow to the fresh food compartment 103, such as, for example, by closing the damper 105. Additionally, when the temperature sensor 248 determines that a temperature in the freezer compartment 101 is above a selected temperature (for example about −18 degrees Celsius), the controller 322 changes the mode of operation of the cooling system 200, such as, for example, activating the cooling system 200. Additionally, the controller 322 changes the mode of operation of the ice producing apparatus 500 when the temperature sensor 248 determines that the temperature in the ice compartment 540 is above a predetermined temperature (for example about −2 degrees Celsius), such as activating the cooling system 200.

The refrigerator 100 also includes a defrost mode. The defrost mode is initiated based on inputs received from the water sensor 240, the door switch sensor 324 and/or the temperature sensor 248. For example, once the ice producing apparatus 500 has made ice a predetermined number of times, the controller 322 initiates the defrost mode. Specifically, the water sensor 240 records the number of water fills of the ice mold 580, by either incrementing or decrementing a counter for each water fill until the counter reaches a predetermined threshold amount. At such a time, the controller 322 initiates the defrost mode. Additionally, once the door has been opened a predetermined number of times, the controller 322 starts the defrost operation. Thus, the door switch sensor 324 records the number of door openings by either incrementing or decrementing each door opening until the given number of door openings has been reached. In the exemplary embodiment, the controller 322 also operates the defrost mode based upon a predetermined time lapse, such that a defrost cycle is initiated after a predetermined amount of time has passed. Additionally, each door opening and each water fill reduces the amount of time remaining until the next defrost mode by predetermined increments.

Figure 10:
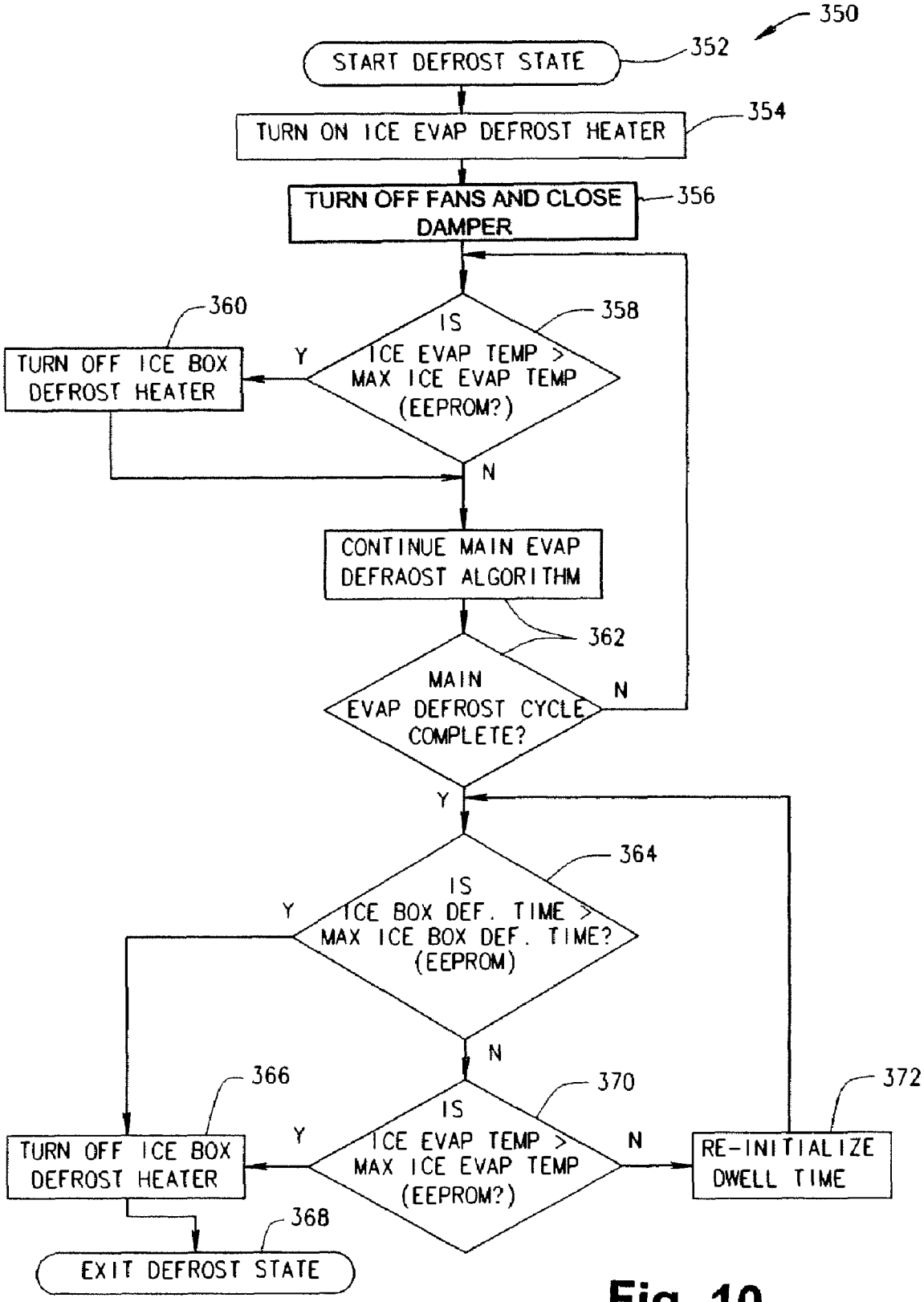
FIG. 10 is a flow chart illustrating an exemplary function of the control system illustrated in FIG. 9.
Figure 11:
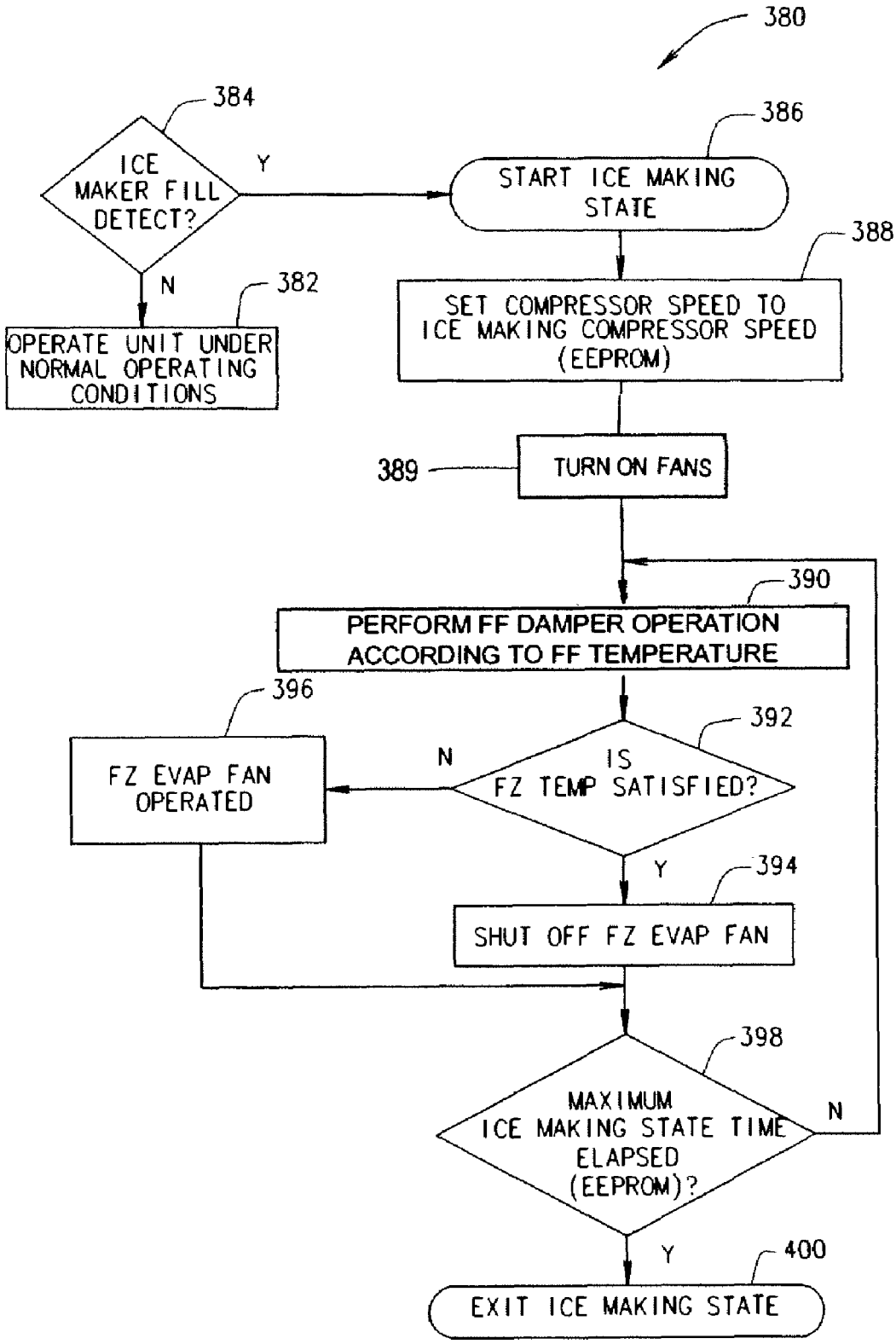
FIG. 11 is another flow chart illustrating an exemplary function of the control system illustrated in FIG. 9.
Figure 12:
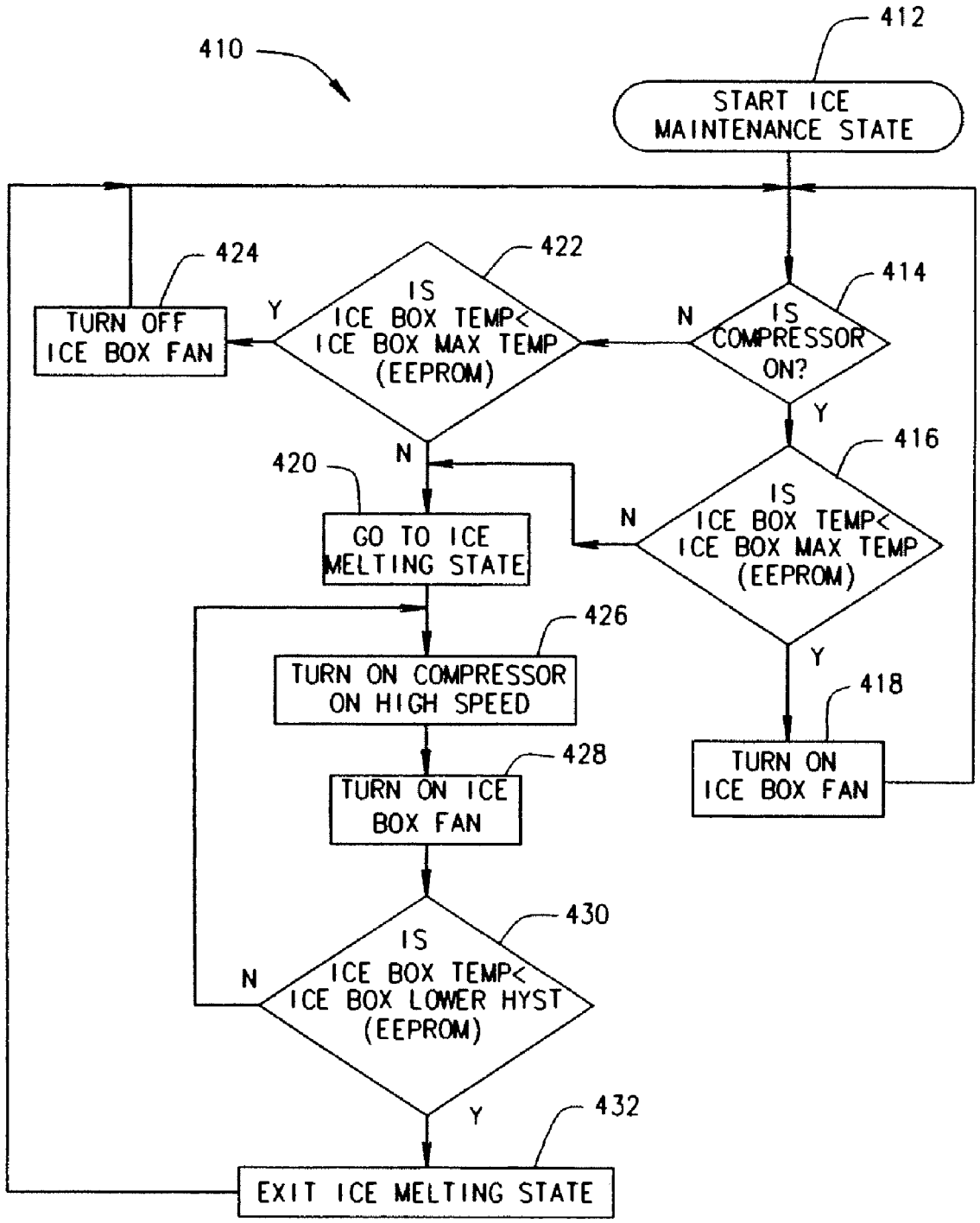
FIG. 12 is another flow chart illustrating an exemplary function of the control system illustrated in FIG. 9.

FIGS. 10-12 are flow charts illustrating certain exemplary operating modes of the control system 320, namely the defrost mode, the ice making mode and the ice maintenance mode, respectively. Because the defrost mode takes precedence over other operating modes, it is described first, with reference primarily to FIG. 10. Specifically, FIG. 10 illustrates an exemplary defrost algorithm (350) for the controller 322 operating the refrigerator 100 in a main defrost state or mode of operation, wherein both evaporator 210 and evaporator 520 are being defrosted. Once defrost mode is initiated (352), as determined by the inputs to the controller 322, heaters (not shown) that may be disposed adjacent the evaporators 210 and 520 are turned on (354) and airflow to the compartments is restricted, such as, for example, by turning off the fans 220 and/or 560 and closing the damper 105 (356). The heaters are used to defrost at least some of the cooling system 200 and ice producing apparatus 500 components, such as, for example, the compressor 214, the condenser 216, the evaporator 210 and/or the evaporator 520.

In operation, the temperature of the evaporator 210 and/or the evaporator 520 is determined (358). If the temperature is greater than a predetermined temperature indicative of ice having been sufficiently removed from the coils of a particular one of the evaporators, the heater adjacent that evaporator is turned off (360). If the temperature of the particular evaporator is less than the maximum temperature, the evaporator defrost algorithm continues (362). This evaporator defrost cycle continues until both evaporators reach a predetermined temperature or a predetermined time out time has elapsed.

When the defrost state is completed, the fans 220 and 560 remain turned off until the temperatures of their associated evaporators 210 and 520 cool to a predetermined temperature. However, this condition may be overridden if the temperature within the ice compartment 540 is above a predetermined temperature, to prevent ice melting. Additionally, the defrost cycles are cancelled if the temperature within the freezer compartment 101 and/or the ice compartment 540 rises above a predetermined temperature, to prevent melting. In one embodiment, the ice producing apparatus 500 defrost cycle may be initiated without initiating the evaporator 210 defrost cycle, depending on the inputs received at the controller 322.

FIG. 11 is a flow chart illustrating an exemplary ice making algorithm (380) for the controller 322 operating the refrigerator 100 in the ice making state or mode of operation. The controller 322 enters the ice making state whenever an ice maker fill (filling of the ice mold 580) is detected by the water sensor 240. Upon detection of the fill (384), the ice making state is initiated (386). The variable speed compressor 214 is set to a predetermined ice making compressor speed (388). In the exemplary embodiment, the ice making compressor speed is a maximum compressor speed. The fan 560 is operated to cool the ice compartment 540 and to facilitate making ice (389). In the exemplary embodiment, the compressor 214 is operated for approximately two hours after the ice making state ceases.

During the ice making state, the compressor 214 is already operating at maximum speed. However, the temperatures of the fresh food compartment 103 and the freezer compartment 101 are monitored. When cooling in either compartment is demanded, the cooling system 200 is operated to cool the compartment. In the exemplary embodiment, during the ice making state, a fresh food (FF) damper operation is performed (390) in order to maintain the desired temperature condition in the fresh food compartment 103. For example, when cooling is demanded in the fresh food compartment 103, the damper 105 is opened to allow cooling airflow from the freezer compartment 101.

During the ice making state, if the temperature of the freezer compartment 101 is below a predetermined temperature, the fan 220 is shut off (394). If the temperature is above a predetermined temperature, the fan 220 is operated (396) to cool the freezer compartment 101.

During the ice making state, the time that the refrigerator 100 is in the ice making state is determined (398). When the maximum time of ice making has elapsed, the ice making process is ended and the controller 322 exits the ice making state (400).

FIG. 12 is a flow chart illustrating an exemplary ice maintenance algorithm (410) for the controller 322 operating the refrigerator 100 in an ice maintenance state or mode of operation.

The ice maintenance state is the default state, and thus this state is initiated (412) whenever the refrigerator 100 exits the defrost state, the ice making state, or an ice melting prevention state. When the ice maintenance state is initiated (412), the ice maintenance process controls the operation of the compressor 214 and the fan 560. Specifically, the ice maintenance process operates the compressor 214 and the fan 560 to establish and maintain the temperature in the ice compartment 540 below a predetermined maximum temperature, thus cooling the ice compartment 540 to maintain the ice. On entering the ice maintenance state, the operational state of the compressor 214 is determined (414) and the temperature in the ice compartment 540 is determined (416). For example, if the compressor 214 is on, and the temperature in the ice compartment 540 is less than a predetermined maximum temperature, the fan 560 is then turned on (418). The process continues to monitor the state of the compressor 214 and the temperature in the ice compartment 540. If the compressor 214 is off, the fan 560 is turned off (424). If the temperature in the ice compartment 540 rises above the predetermined maximum temperature, the ice maintenance process is directed to the ice melting prevention state or process (420).

In the ice melting prevention state, the cooling system is operated to rapidly restore the temperature in the ice compartment 540 to within the desired temperature range. To that end, the compressor 214 is turned on (426) to a maximum compressor speed. The fan 560 is turned on (428), and the temperature of the ice compartment 540 continues to be monitored (430). If the temperature in the ice compartment 540 is greater than a predetermined temperature, then the ice melting prevention state is started. When the temperature in the ice compartment 540 drops below this temperature, the controller 322 exits the ice melting state (432), and the ice making or ice maintenance state is continued. As stated above, the system remains in the ice maintenance state until the refrigerator 100 enters one of the defrost state, the ice making state, or the ice melting prevention state.

In the embodiments hereinbefore described, the evaporator compartment 530 and the evaporator 520 are disposed adjacent the back wall 113 of the fresh food compartment 103. In an alternative embodiment, the evaporator 520 and the evaporator compartment 530 may be located in the mullion between the fresh food compartment 103 and the freezer compartment 101. Structural differences for this embodiment are described with reference to FIGS. 13 and 14.

Figure 13:
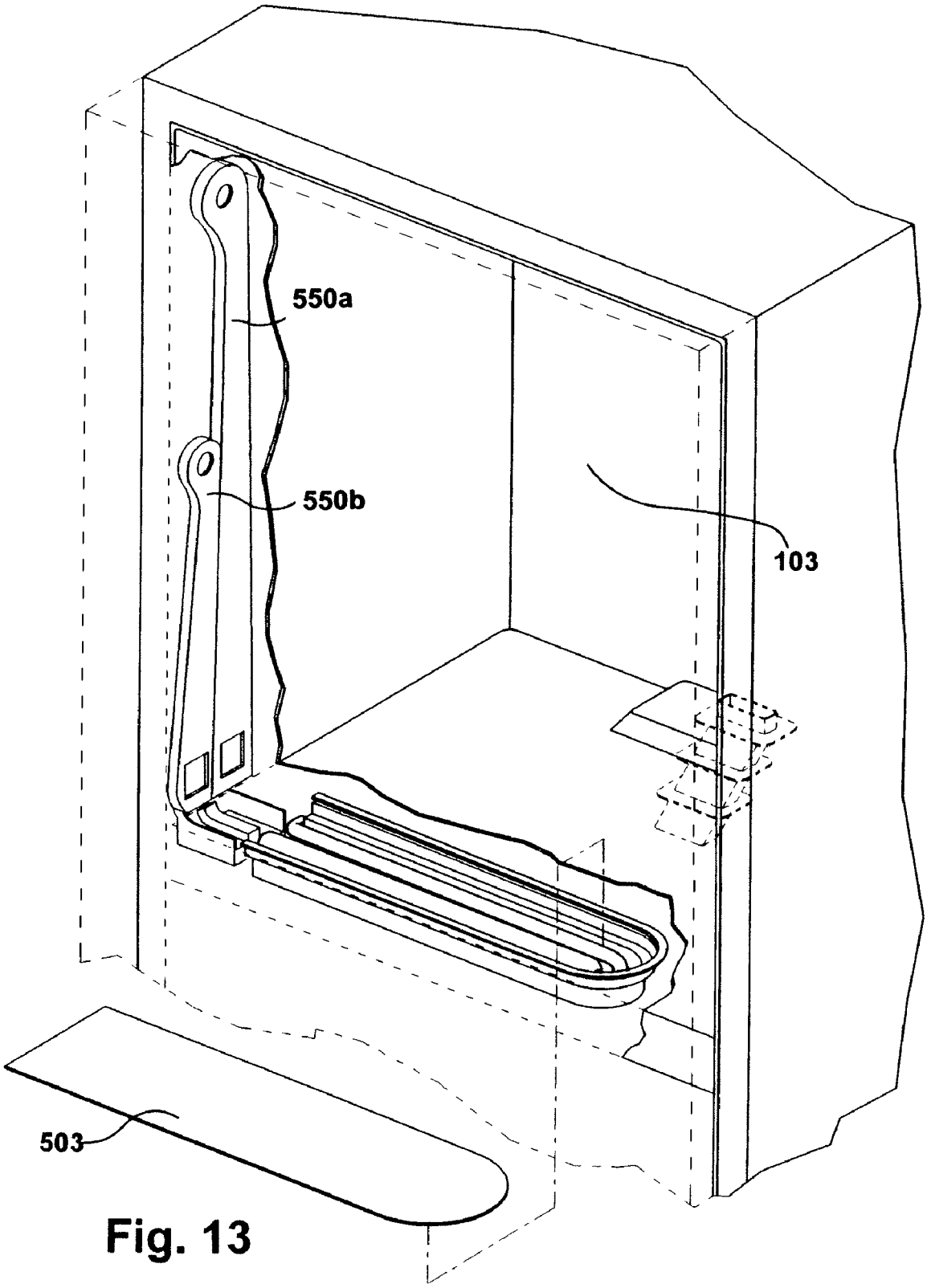
FIG. 13 is a detail, front isometric view, with the door of the top fresh food compartment shown in phantom, illustrating an embodiment of a cold air flow channel for another embodiment of an ice producing apparatus.
Figure 14:
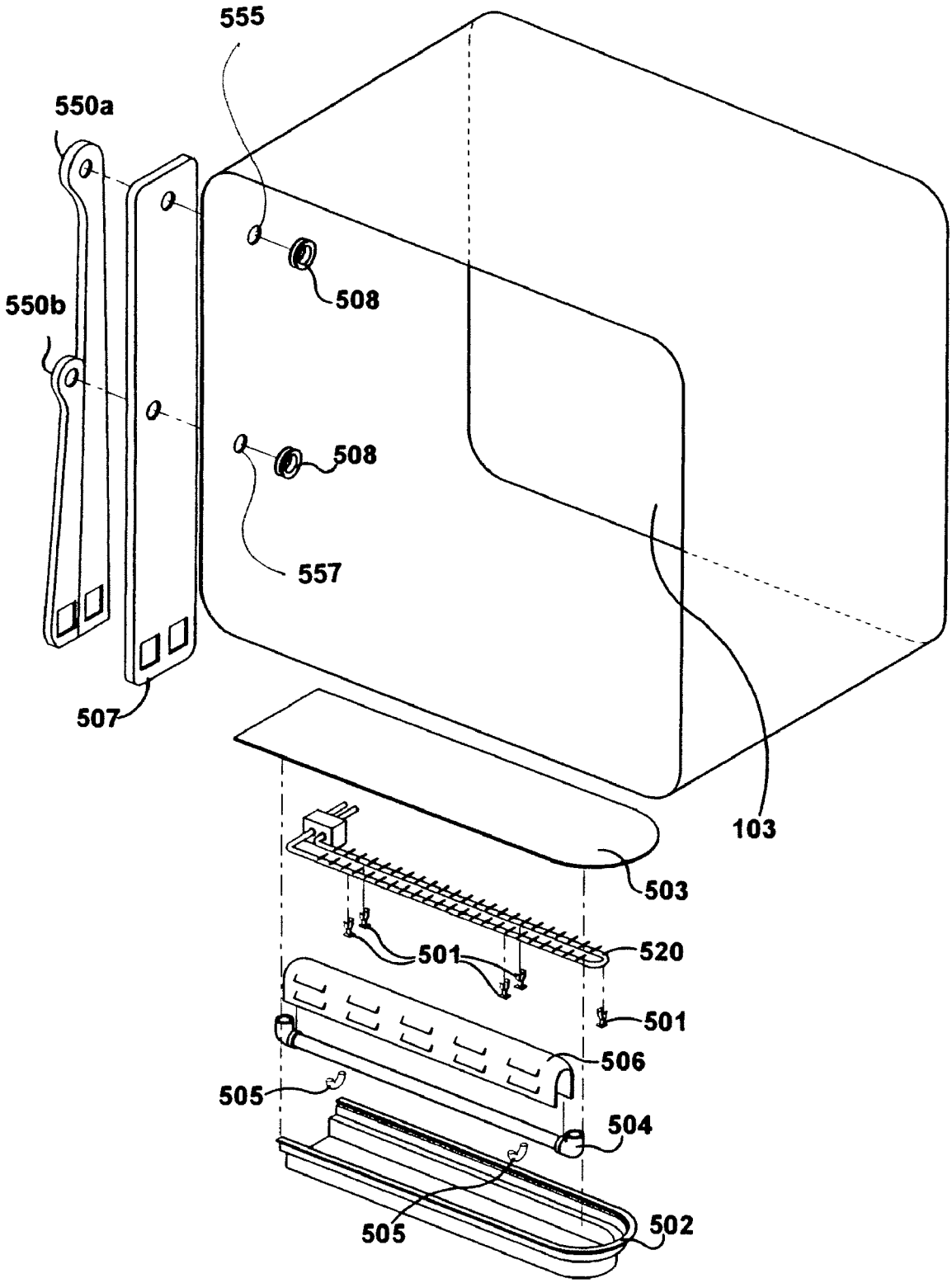
FIG. 14 is a schematic view of components forming another embodiment of an ice producing apparatus, usable with the cold air flow channel of FIG. 13.

FIG. 13 is a front isometric view, with the door 107 of the top fresh food compartment 103 shown in phantom, illustrating an embodiment of the cold air flow channels for an evaporator compartment located in the mullion between the fresh food and freezer compartments. FIG. 14 is a schematic view of components forming this embodiment of the ice producing apparatus 500, usable with the cold air flow channels of FIG. 13.

As shown in FIG. 13, the cold air flow channels 550*a* and 550*b* are disposed within the side wall of the interior volume (i.e., within the wall) of the fresh food compartment 103. The cold air is provided to the ice producing apparatus 500 through the longer flow channel 550*a*, while the warm air flows from the ice producing apparatus 500 through the shorter flow channel 550*b*.

The above configuration of the cold air flow channels 550*a* and 550*b* are used with the arrangement of the components of the ice producing apparatus shown in FIG. 14. As shown in the figure, in this embodiment components of the ice producing apparatus 500 are disposed in the mullion between the bottom freezer compartment 101 and the top fresh food compartment 103. Specifically, the evaporator 520 is disposed on supports 501 between a bottom drain pan 502 and a top removable cover 503. As shown in FIG. 13, the removable cover 503 forms at least a portion of a bottom surface of the fresh food compartment 103. A defroster heater 504 is disposed on supports 505, and used in a known manner to prevent ice formation between the drain pan 502 and cover 503. An airflow divider 506 is disposed between the drain pan 502 and cover 503, to define the flow path for cool air from the evaporator 520 and the flow of warm air to the evaporator 520. Insulation 507 is disposed between the cold air flow channels 550*a* and 550*b* and the fresh food compartment 103. Seals 508 are used to seal the cold air flow channels 550*a* and 550*b* located in the fresh food compartment 103 with respect to the inlet and outlet 551 and 553 of the ice producing apparatus 500 located on the door 107.

It is to be understood that although the cold air flow channels are shown and described in specific locations in the refrigerator 100, the cold air flow channels are not limited to any particular location. Rather, the cold air flow channels can be disposed in various locations throughout the refrigerator 100, as long as the cold air flows to the ice producing apparatus 500 from the evaporator 520 through the cold air flow channel.

It is further to be understood that although components of the cooling system 200 are shown and described in specific locations in the refrigerator 100, these components are not limited to any particular locations. Rather, any or all of the components of the cooling system 200 can be disposed in various locations throughout the refrigerator 100, including above the freezer and fresh food compartments 101 and 103, such as on an outside, top portion of the refrigerator 100. Similarly, although the evaporator 520 is shown and described as being disposed in the back portion of the fresh food compartment 103 (as shown in FIG. 1), and alternately in the mullion (as shown in FIG. 13), the evaporator 520 is not limited to any particular location, and can be disposed in various locations throughout the refrigerator 100.

This written description uses examples to disclose embodiments of the invention, including the best mode, and also to enable a person of ordinary skill in the art to produce and use embodiments of the invention. It is understood that the patentable scope of embodiments of the invention is defined by the claims, and can include additional components occurring to those skilled in the art. Such other arrangements are understood to be within the scope of the claims.

The invention claimed is:

1. A refrigerator comprising:

a first storage compartment defining a first interior volume;

a first evaporator disposed in a first evaporator compartment and configured to provide cool air to the first interior volume;

a second storage compartment defining a second interior volume, the second interior volume being configured to be cooled by cool air received from the first interior volume;

a door positionable to permit and prohibit access to the second interior volume through a front of the second interior volume, the door defining therein a third interior volume;

a second evaporator disposed in a second evaporator compartment that is separate and spaced from the third interior volume and configured to provide cool air to the third interior volume;

an air flow channel extending from the second evaporator compartment to the third interior volume, the channel being configured to flow air from the second evaporator compartment to the third interior volume;

a fan disposed in the third interior volume; and a mold disposed in the third interior volume and configured to receive water and to retain the water during cooling of the water.

2. The refrigerator of claim 1, further comprising:

a receptacle disposed in the third interior volume and configured to receive and to retain ice formed in the mold.

3. The refrigerator of claim 1, wherein the second evaporator is disposed adjacent the second interior volume.

4. The refrigerator of claim 3, wherein the air flow channel extends along a side of the second interior volume, the side being disposed between the front and a back opposite the front, and the side being disposed between a top and a bottom of the second interior volume.

5. The refrigerator of claim 1, further comprising:

a damper disposed in an opening between the first and second interior volumes, the damper being configured to control air flow between the first and second interior volumes.

6. The refrigerator of claim 5, wherein the damper is configured to selectively permit air flow from the first interior volume to the second interior volume.

7. The refrigerator of claim 6, wherein the damper is configured to impede air flow from the second interior volume to the first interior volume.

8. The refrigerator of claim 1, wherein the first evaporator is configured to cool the first interior volume to a temperature at or below a freezing point temperature of water, and to cool the second interior volume to a temperature above the freezing point temperature.

9. The refrigerator of claim 8, further comprising a damper disposed in an opening between the first and second interior volumes, the damper being configured to control airflow between the first and second interior volumes.

10. The refrigerator of claim 9, wherein the second evaporator is configured to cool the third interior volume to a temperature at or below the freezing point temperature of water.

11. The refrigerator of claim 10, wherein the second evaporator is disposed adjacent the second interior volume.

12. The refrigerator of claim 11, wherein the air flow channel extends along a side of the second interior volume.

13. The refrigerator of claim 12, wherein the door defines an inlet configured to receive the cool air from the air flow channel, the inlet being disposed on a side of the door which extends between a top and a bottom of the door.

14. The refrigerator of claim 1, further comprising a mullion which separates the first storage compartment from the second storage compartment and defines the second evaporator compartment.

15. The refrigerator of claim 14, wherein the second evaporator compartment has a removable cover which forms part of a bottom surface of the second interior volume.

16. The refrigerator of claim 15, further comprising a drain pan disposed in the second evaporator compartment, the second evaporator being disposed between the removable cover and the drain pan.

17. The refrigerator of claim 16, further comprising a defroster heater disposed in the second evaporator compartment and between the removable cover and the drain pan.

18. The refrigerator of claim 14, wherein the air flow channel is disposed in a side wall of the second storage compartment.

* * * * *

UNITED STATES PATENT AND TRADEMARK OFFICE

CERTIFICATE OF CORRECTION

PATENT NO. : 7,614,244 B2
APPLICATION NO. : 11/614253
DATED : November 10, 2009
INVENTOR(S) : Venkatakrishnan et al.

It is certified that error appears in the above-identified patent and that said Letters Patent is hereby corrected as shown below:

In Column 4, Line 10, delete "hack" and insert -- back --, therefor.

Signed and Sealed this

Sixteenth Day of February, 2010

David J. Kappos

David J. Kappos
*Director of the United States Patent and Trademark Office*